US006154551A

United States Patent [19]

Frenkel

[11] Patent Number: 6,154,551

[45] Date of Patent: Nov. 28, 2000

[54] MICROPHONE HAVING LINEAR OPTICAL TRANSDUCERS

[76] Inventor: Anatoly Frenkel, 2974 Senda Del Puerto, Santa Fe, N. Mex. 87505-6511

[21] Appl. No.: 09/160,733

[22] Filed: Sep. 25, 1998

[51] Int. Cl.[7] ..... H04R 25/00

[52] U.S. Cl. ..... 381/172; 381/160; 359/150

[58] Field of Search ..... 381/172, 160, 381/170; 359/149, 150, 152

[56] References Cited

U.S. PATENT DOCUMENTS

| | | | |
|---|---|---|---|
| 5,262,884 | 11/1993 | Buchholz | 359/151 |
| 5,333,205 | 7/1994 | Bogut et al. | 381/172 |
| 5,619,583 | 4/1997 | Page et al. | 381/172 |
| 5,995,260 | 11/1999 | Rabe | 359/150 |

*Primary Examiner*—Curtis A. Kuntz
*Assistant Examiner*—Suhan Ni
*Attorney, Agent, or Firm*—Samuel M. Freund

[57] ABSTRACT

Microphone having linear optical transducers. The present invention includes the use of linear optical transducers in several configurations to detect the motion of one or more conventional microphone diaphragms in proportional response to incident acoustic signals. A light source, such as a laser or a light emitting diode directs light onto a reflecting microphone diaphragm responsive to sound waves, and the position of the reflected light is monitored using a position sensitive detector which effectively eliminates effects of light source intensity on the optical transducer-processed signal. Other embodiments make use of either a fixed knife edge or a knife edge which moves in response to the motion of the diaphragm to interrupt the light source in a proportional manner to the amplitude of motion of the diaphragm.

19 Claims, 4 Drawing Sheets

FIG. 4a.
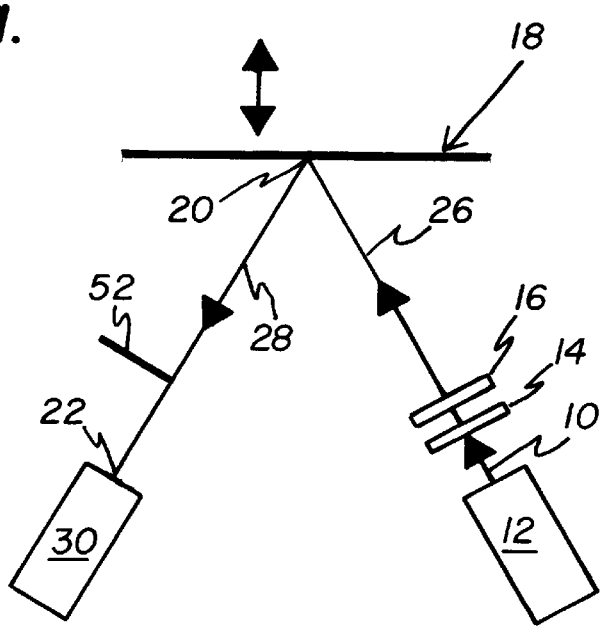
FIG. 4b.
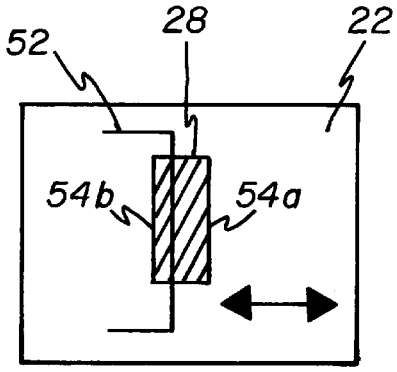
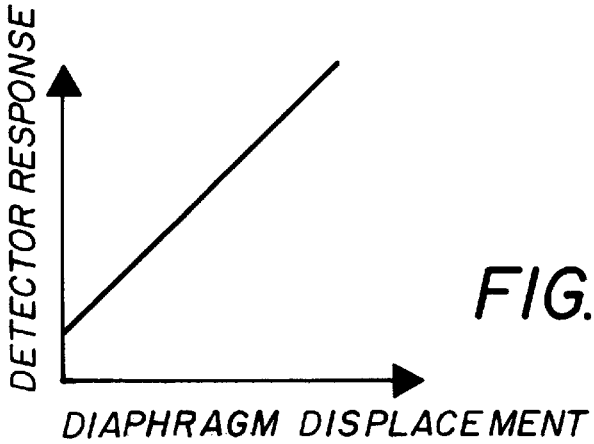
FIG. 4c.

MICROPHONE HAVING LINEAR OPTICAL TRANSDUCERS

FIELD OF THE INVENTION

The present invention relates generally to microphones and, more particularly, to the use of linear optical transducers to convert the motion of a microphone diaphragm into an analog electrical signal in response to sound waves.

BACKGROUND OF THE INVENTION

Significant progress in optoelectronic technology, including reduction in price and improvement in availability and characteristics of key optoelectronic components such as semiconductor lasers, photodetectors, and position-sensing photodiodes, has created an opportunity for improving detection of sound waves using microphones having optical transducers. Optical transducers offer advantages over the non-optical transducers presently used in microphones, including higher resolution, higher signal-to-noise ratio, immunity to electromagnetic radiation, and greater linearity.

In U.S. Pat. No. 5,262,884 for "Optical Microphone With Vibrating Optical Element," which issued to Jeffrey C. Buchholz on Nov. 16, 1993, an optical microphone is described which includes a vibrating membrane defining a diaphragm for receiving acoustic signals, an optical element, such as a lens, attached to the membrane for vibrating therewith in direct relationship with the acoustic input signals, and fixed fiber optic cables placed in alignment with the lens for directing light from a light source at the remote end thereof toward the lens, and transmitting the directed light from the lens to a detector. Single or dual fiber optical geometry may be used.

The lens may be fabricated by placing a drop of optical epoxy directly on the membrane. The vibrating membrane/lens combination varies the amount of light collected by the fiber optic cable at the acoustic signal frequency in a proportional manner to the strength of the acoustic signal. That is, there is a direct relationship between movement of the lens and the vibration of the membrane in response to the receipt of acoustic signals directed onto the surface of the membrane. The fiber optic cables are fine-tuned to optimize the microphone response.

In U.S. Pat. No. 4,422,182 for "Digital Microphone," which issued to Hideyuki Kenjyo on Dec. 20, 1983, a microphone which generates a digital signal in response to a diaphragm is described. A cylindrical reflecting mirror is integrally attached to the diaphragm and reflects a band-shaped light beam to an array of photoelectric transducers. A binary code pattern is formed on the surface of the mirror which modulates the incident light beam as the relative position of the code pattern and the light beam varies. The modulated light beam is transformed into the digital signal by the array of photoelectric detectors. The binary code pattern consists of a combination of reflecting and non-reflecting areas arranged as four bit words, while the detector comprises an array of four photoelectric transducers because the pattern is a four bit binary code pattern. As the diaphragm moves under the influence of incident acoustic energy, the binary code pattern is scanned by the by the band-shaped light beam, thereby modulating the light beam which is incident on the transducers, whereby the modulated light beam is converted into a digital signal, each transducer being related to respective bits of the binary code. Thus, the binary code output signal designates the amount and direction of the displacement of the diaphragm. In another embodiment of the Kenjyo invention, an aluminum film having the binary code pattern is applied to the light-receiving surface of the transducers. This pattern consists of a combination of light transmitting areas and light absorbing areas.

In U.S. Pat. No. 3,286,032 for "Digital Microphone," which issued to Elmer Baum on Nov. 15, 1966, an earlier microphone for generating a digital code output directly from sound waves is described. A diaphragm intercepts sound waves, and a motion is imparted thereto which is proportional to the amplitude of the sound wave. A plurality of photosensitive devices is arranged in a code matrix, and light from a source thereof is directed through a collimating device having a line configuration onto a mirror suspended from or attached to the diaphragm which reflects the light onto the matrix. A timing generator produces periodic pulses to sample the code matrix. The sampling is achieved by having the code matrix include a plurality of photosensitive devices arranged to be activated by the sampling pulse and to pass or gate an output to the digital outputs when excited by the reflected light.

In the previous two references, direct digital output from the microphone, which is directly related to the displacement of the microphone diaphragm, was believed to be necessary in order to avoid the use of A/D converters in digital recording audio systems for converting analogue sound signals into digital recordings.

In U.S. Pat. No. 5,333,205 for "Microphone Assembly" which issued to Henry A. Bogut and Joseph Patino on Jul. 26, 1994, a microphone assembly is described which includes a movable diaphragm and a linear light gradient device which translates the movement of the diaphragm into a corresponding amplitude of light to be received at a photodetector. That is, light traveling through an optical fiber is directed through an optical conversion means such as a linearly variable density light gradient (optical filter) which is attached to the diaphragm. A linearly variable neutral density filter having a length of approximately the maximum amount of deflection which the diaphragm can undergo is preferred. As the diaphragm is modulated by sound pressure waves, the light gradient moves an equal amount causing different amounts of light to travel to a recovery optical fiber; the light gradient device is moved between the gap formed by the optical fibers causing different amounts of light to pass corresponding to the amount of deflection. The amplitude modulated optical signal recovered by the optical fiber is detected by a photodetector which converts the received light into corresponding electrical signals. The use of a variable attenuation shutter is also described.

In U.S. Pat. No. 2,835,744 for "Microphone" which issued to Francis S. Harris on May 20, 1958 a microphone is described where a light source, a fixed entrance slot for collimating the light from the light source, a detector, and a fixed exit slot for blocking stray light from reaching the detector, are placed on one side of an acoustic-wave sensitive diaphragm. The two fixed slots are aligned such that the light from the light source passes directly through each slot and impinges on the detector. A shutter, having the form of a flat plate of material also having a slot therein, is fastened to the diaphragm in such a manner that it moves therewith, is located between the two fixed slots. When sound waves impinge on the diaphragm, the shutter is displaced, thereby changing the amount of light reaching the detector.

A particularly desirable quality of microphones which have optical transducers is independence from variations in light intensity. Additionally, linearity of response is essential. Although microphone diaphragm technology has evolved such that linearity of motion in response to acoustic input is excellent, none of the above-described references teach the use of linear motion detection systems to take advantage of this technology.

Accordingly, it is an object of the present invention to provide an optical microphone for simultaneously monitoring the spatial and temporal location of light directed onto a diaphragm moving in response to incident sound waves and reflected therefrom.

Yet another object of the present invention is to provide an optical microphone for simultaneously monitoring the spatial and temporal location of light directed onto a diaphragm moving in response to incident sound waves and reflected therefrom, such that the detected signal is independent of the intensity of the light.

Still another object of the invention is to provide an optical microphone for simultaneously monitoring the spatial and temporal location of light directed onto a diaphragm moving in response to incident sound waves and reflected therefrom, such that the detected signal is linearly related to the motion of the diaphragm.

A further object of the invention is to provide an optical microphone for temporally monitoring the intensity of light directed onto a diaphragm moving in response to incident sound waves and reflected therefrom where the reflected light is partially blocked by a fixed edge.

Yet a further object of the invention is to provide an optical microphone for temporally monitoring the intensity of light directed onto a detector and interrupted by a beam stop which follows the motion of a diaphragm moving in response to incident sound waves.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the optical microphone hereof having a pressure-actuated diaphragm responsive to sound waves impinging thereon includes: reflective means attached to the pressure-actuated diaphragm and adapted to move therewith; a light source for providing light directed onto the reflective means and having a chosen intensity; and a detector for monitoring the position of the light reflected by the reflective means and generating a signal therefrom proportional to the movement of the diaphragm, whereby the generated signal is independent of the intensity of the light.

Preferably, the source of light includes lasers and light emitting diodes.

It is also preferred that the reflective means includes a reflective coating on the surface of the diaphragm away from the impinging sound waves.

In another embodiment of the invention, in accordance with its objects and purposes, as embodied and broadly described herein, the optical microphone hereof having a pressure-actuated diaphragm responsive to sound waves impinging thereon includes: reflective means attached to the pressure-actuated diaphragm adapted to move therewith; a light source for providing light directed onto the reflective means and having a chosen intensity; a knife-edge having a fixed position for blocking a portion of the light reflected by the reflective means; and a detector for monitoring the intensity of the portion of the light which is not blocked by the knife edge and generating a signal therefrom proportional to the movement of the diaphragm.

Preferably, the source of light includes lasers and light emitting diodes.

It is also preferred that the reflective means includes a reflective coating on the surface of the diaphragm away from the impinging sound waves.

In still another embodiment of the invention, in accordance with its objects and purposes, as embodied and broadly described herein, the optical microphone hereof having a pressure-actuated diaphragm responsive to sound waves impinging thereon includes: a light source for providing light having a chosen intensity; a detector for monitoring the intensity of the light from the laser and generating a signal therefrom; and a knife edge attached to the pressure-actuated diaphragm and adapted to move therewith, whereby the knife edge intersects the light between the laser and the detector and modulates the intensity of the light in an amount proportional to the motion of the diaphragm.

Preferably, the source of light includes lasers and light emitting diodes.

Benefits and advantages of the present optical microphone include linear response proportional to the motion of the diaphragm in response to acoustic waves incident thereon, and freedom from variations in the intensity of the laser light used to track the motion of the diaphragm.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIGS. 3*a* and 3*b* are schematic representations of two embodiments of position-sensitive detectors, while

FIG. 4*a* is a schematic representation of a third embodiment of the microphone of the present invention showing the use of a fixed knife edge for generating a modulated signal responsive to the motion of the microphone diaphragm by blocking a portion of the light reflected by the diaphragm and received by the detector, FIG. 4*b* is a conceptualization of the motion of the partially blocked reflected on the active area of the detector, and FIG. 4*c* shows the expected linear response of the detector to the motion of the microphone diaphragm.

DETAILED DESCRIPTION

Briefly, the present invention includes the use of linear optical transducers in several configurations to detect the motion of one or more conventional microphone diaphragms in proportional response to incident acoustic signals. A light source, such as a laser or a light emitting diode directs light onto a reflecting microphone diaphragm responsive to sound waves, and the position of the reflected light is monitored using a position sensitive detector which effectively eliminates effects of light source intensity on the optical transducer-processed signal. Other embodiments make use of either a fixed knife edge or a knife edge which moves in response to the motion of the diaphragm to interrupt the light source in a proportional manner to the amplitude of motion of the diaphragm.

Having generally described the present invention, the following examples provide additional detail for enabling the practice the invention.

EXAMPLE 1

Reference will now be made in detail to the present preferred embodiments of the invention examples of which are shown in the accompanying drawings. Identical callouts are used to identify similar or identical structure.

Figure 1:
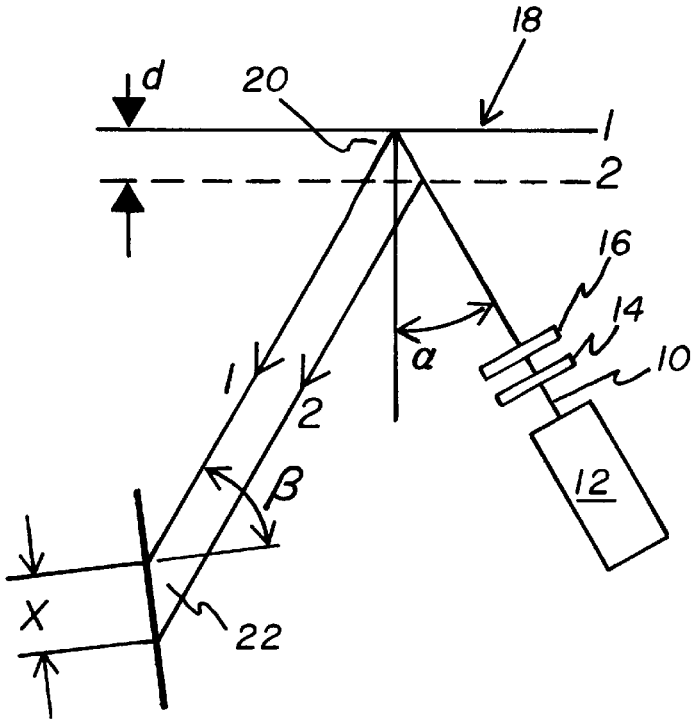
FIG. 1 is a schematic representation of the microphone of the present invention showing, in particular, the displacement of light incident on the reflective surface of the microphone diaphragm when the diaphragm moves in response to impinging sound waves.

A first embodiment of the microphone of the present invention having an optical transducer is shown in FIG. 1. Light, 10, from a light source, such as a laser or a light emitting diode (LED), 12, is directed through diffraction diffuser, 14, and cleaning aperture, 16, onto into stretched, pressure diaphragm, 18, from which it is reflected by reflective surface, 20, onto the surface, 22 of a photodetector. A typical laser for light source 12 might be a semiconductor laser. Certain light sources, such as LEDs, require focusing lenses, and light source 12 will be considered as including such lenses where appropriate. As will be described further hereinbelow, the use of diffuser 14 and aperture 16 is required only for certain embodiments of the present invention. Sound waves to be recorded deflect diaphragm 18 in a linear fashion (that is, with flat acoustical frequency response) in a similar manner to that of a pressure diaphragm found in commercially available condenser microphones. This results in a displacement, X, of the laser beam on detector surface 22 as shown in FIG. 1. The position of the laser beam is sensed by the detector, thereby producing an output I 5 current that is proportional to the displacement of the laser beam with high degree of linearity and having a modulation frequency proportional to the frequency of the incident sound wave. The displacement of a laser beam on the detector surface, X, is given by:

$$X=2d \sin E/\cos \beta, \quad (1)$$

where d is the displacement of the pressure diaphragm, and $\alpha$ and $\beta$ are angles of incidence on the diaphragm and on the detector, respectively. From Eq. 1 it is seen that X is linear with d and can be significantly increased by using large angles $\alpha$ and/or $\beta$. A light source having appropriate parameters (power, spatial uniformity, wavelength in the visible or near infrared, etc.) is chosen based on the detection methods described hereinbelow, as well as based on the particular application of the microphone. It is desirable that all of the components fit rigidly into a light-tight microphone head (not shown in the Figures). However, laser power can be delivered to the microphone head through a fiber-optic cable, if geometrical or other considerations require this to be so. In that way, a single light source can serve multiple microphones.

Typical metal diaphragms (stainless steel, nickel, chromium, nickel alloys, aluminum alloys, etc.), designed for condenser microphone and optimized for a flat acoustical frequency response can be used directly or with minor modification in a microphone with the optical transducers of the present invention. This is because metals or metal alloys are good reflectors in the visible and near infrared part of the spectrum. For the optical microphone of the present invention the surface of the diaphragm facing the laser beam has adequate optical quality. However, it is anticipated that a reflective coating might be applied to surface 20 of the diaphragm to improve its reflectivity.

The microphone of the present invention has low sensitivity to temperature variations. Indeed, shifts in the position of the incident light on the diaphragm due to temperature changes would not affect the ac-coupled electrical output of the optical transducer. This is an advantage over condenser microphones where temperature stability is more critical for the transducer performance.

EXAMPLE 2

Figure 2:
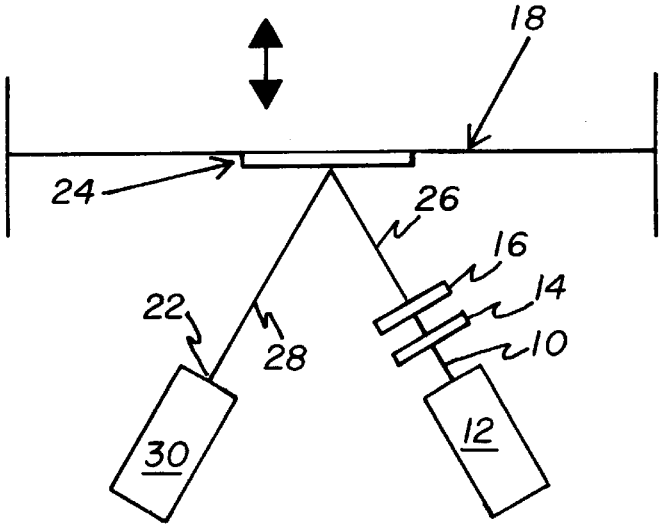
FIG. 2 is a schematic representation of a second embodiment of the microphone of the present invention and shows a reflective device attached to the surface of the diaphragm opposite the surface thereof exposed to the impinging sound waves.

A second embodiment of the present microphone uses the principle of a dynamic moving-coil microphone which are often dome shaped (not shown in the Figures). A small optical mirror, 24, is attached to the diaphragm in place of a moving coil, as shown in FIG. 2. The difference from the microphone illustrated FIG. 1 is that uniform optical beam, 26, (processed by optical elements 14 and 16) is reflected, 28, by mirror 24 onto surface 22 of detector, 30, and not by the inner surface of the pressure diaphragm. This eliminates the requirement of good optical quality for this surface of the diaphragm, thereby allowing more flexibility in diaphragm shape and in the choice of diaphragm material (not necessarily metals or metal alloys). In dynamic moving-coil microphones, the microphone response is proportional to the speed of motion attainable by the diaphragm and frequency response is optimized for flatness. In the present optical transducer microphone flat frequency response optimization is achieved using conventional dynamic, moving-coil designs. Another parameter which may be optimized is the linear displacement of the diaphragm, which allows greater flexibility in the choice of the shape and the materials of construction of the diaphragm.

Several detection methods are anticipated to be useful for the present optical transducer microphone. First, position-sensitive detectors (PSDs) appropriate for use in the microphone embodiments illustrated in FIGS. 1 and 2 are described. Position-sensitive detectors are silicon photodiodes that provide an analog output that is directly proportional to the position of the light spot incident on the detector area. Such detectors provide outstanding position linearity (typically better than 0.05%), high analog resolution (better than 1 part per million), and fast response time (typically several microseconds). Another advantage of PSD detection is the ability to monitor the displacement of the pressure diaphragm independently of the intensity of light.

Figure 3A:
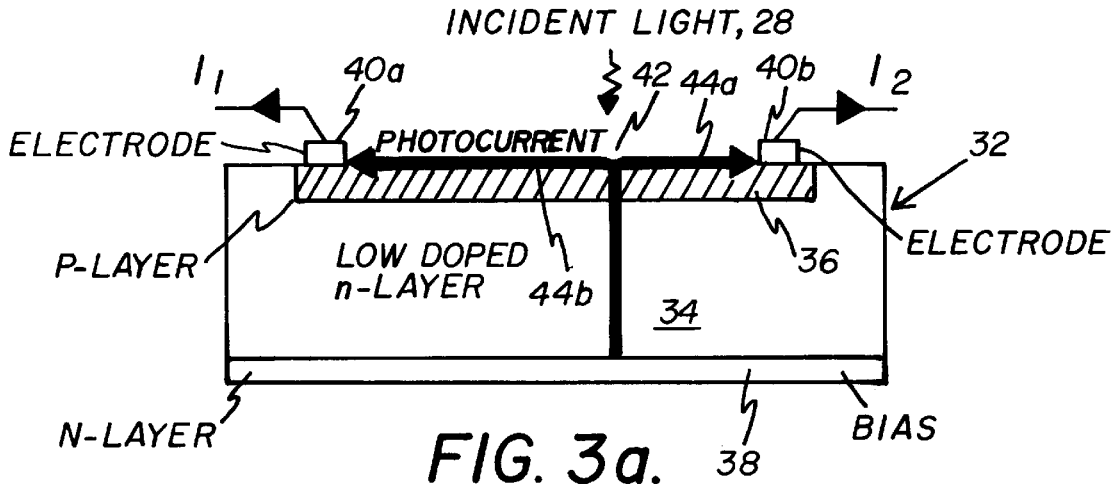

FIG. 3*a* schematically illustrates a commercially available PSD suitable for use in the present microphone. Position-sensitive detector, 32, consists of n-type silicon substrate, 34, with two resistive layers, 36, 38, separated by a p-n junction. The side facing the incoming light has an ion-implanted, p-type resistive layer with two contacts, 40*a* and 40*b* at opposite ends. The other side has an ion-implanted, n-type resistive layer with two contacts (not shown in FIG. 3*a*) at opposite ends placed orthogonally to the contacts on the side facing the incoming light. Light incident on the surface at location, 42, and having a spectral range which is absorbed by silicon, generates a photocurrent, 44*a* and 44*b*, which flows from the incident location through the resistive layers to the electrodes 40*a* and 40*b*. The resistivity of the ion-implanted layer is extremely uniform so the photo-generated current at each electrode is inversely proportional to the distance between the incident location of the light and the electrodes. The PSD output, then, tracks the motion of the "centroid of power density" with high resolution and linearity. Optical elements 14 and 16 shown in FIGS. 1 and 2 are not required for this type of PSD.

Figure 3C:
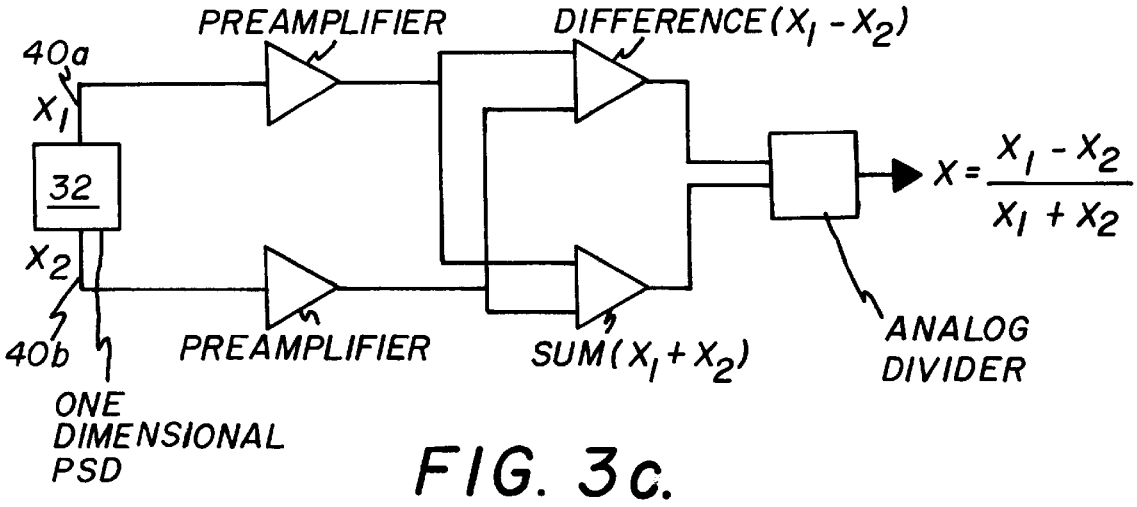
FIG. 3*c* illustrates a circuit for detecting the light impinging on a position-sensitive detector in a manner which is independent of the intensity of the light.
Figure 3B:
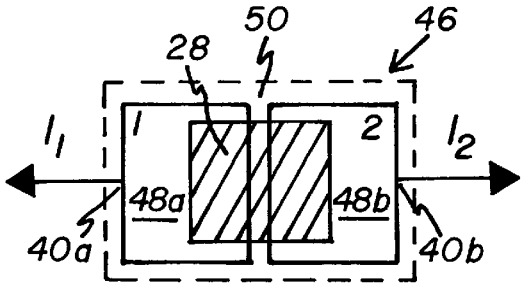

FIG. 3*b* illustrates a second embodiment, 46, of a PSD, where position-sensing detection is achieved using a commercially available dual-element (bi-cell) detector. Again, both microphone methods described in FIGS. 1 and 2 can be used. However, beam forming elements 14 and 16 thereof are used, since a highly uniform intensity pattern (spatial distribution of intensity) must be generated out of a typical laser beam having a Gaussian intensity distribution. This is accomplished by directing the light beam through a diffraction diffuser. An additional aperture (optional) is used for better pattern definition and for removal of scattered light. The dual-element detector shown has two discrete elements, 48*a* and 48*b*, located next to each other and having a small gap, 50, therebetween (typically 50–100 microns) on a single substrate. When light beam, 28, is centered on the cells, the output current from each element is the same. As the beam moves, a current imbalance is generated and a signal proportional to the displacement of the beam can be recovered at electrodes 40*a* and 40*b* using appropriate signal processing. The difference of electrical signals from the two elements of the dual-element is linearly proportional to the displacement of the uniform light beam pattern due to the displacement of a pressure diaphragm.

FIG. 3*c* shows one circuit design which can be used for processing the signal outputs from either of the PSD and dual-element detectors shown in FIGS. 3*a* and 3*b*, respectively. This circuit permits the intensity independent reading of the light spot displacement with high degree of linearity and accuracy. Photocurrent outputs are converted to a voltage and amplified by preamplifiers. The voltage signals are further processed to yield sum and difference signals, which are divided by an analog divider circuit. Thus, the intensity independent output is given by $$X = \frac{X_1 - X_2}{X_1 + X_2}, \tag{2}$$

where $X_1$ and $X_2$ are the output signals from the two electrodes of the PSD or the dual element detectors. Since the laser source output beam intensity is very stable for semiconductor lasers, the outputs $X_1$ or $X_2$ can be used directly (after amplification using preamplifiers) as signals proportional to the displacement of the pressure diaphragm. This eliminates the need for an additional electronic processing, thus improving signal-to-noise ratio (reducing noise and increasing sensitivity).

EXAMPLE 3

Another embodiment of the present invention utilizes a fixed, knife edge aperture, 52, for intensity modulation of the laser beam proportional to the diaphragm displacement, and a highly linear detector (e.g., commercially available Si PIN or avalanche diodes), and is illustrated schematically in FIG. 4*a*. A highly uniform pattern (spatial distribution of intensity) must be generated from the light source, for example, a laser having a Gaussian distribution of intensity, by directing the light beam through optical elements 14 and 16. Light beam 26 possesses a square- or rectangular-shaped highly uniform distribution of intensity and sharp edges. After reflection from diaphragm 18, the light beam is filtered by a fixed-edge aperture 52. This produces an amplitude modulation of the light impinging on face 22 of detector 30 as is shown in FIG. 4*b* where the amplitude, 54*a*, of light beam 28 reaching face 22 is determined by the amount, 54*b*, of light beam 28 that is blocked by aperture 52. Amplitude modulation of the detected light by aperature 52 results in an electrical signal (photocurrent) being generated by detector 30 (FIG. 4*b*) which is expected to be proportional to the displacement of the pressure diaphragm as is schematically illustrated in FIG. 4*c*. Typically, photodiodes have responses on the order of a nanosecond and bandwidths of hundreds of MHz which is sufficient for audio applications. Linearity of PIN photodiodes can reach 7–9 decades with signal-to-noise ratios better than 100:1 with properly designed electronics.

There are two major sources of noise in PIN photodiodes: shot noise and thermal noise in the load resistor with total noise current, $I_n$, given by $$I_n = \sqrt{2qI_n\Delta f + 4kT\Delta f/R_L}' \tag{2}$$

where q is the electron charge, $I_n$ is the dark current, $\Delta f$ is the noise bandwidth, and T is the photodiode temperature. Electronic circuits will be designed for specific audio applications to minimize the overall noise by optimizing the mode of operation (that is, photovoltaic or photoconductive for PIN photodiodes) of the photodetector, load resistance, spectral bandwidth, output impedance matching, etc.

EXAMPLE 4

Figure 5:
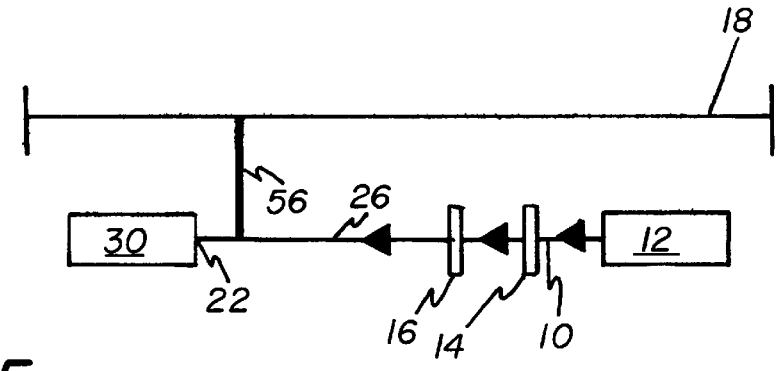
FIG. 5 is a schematic representation of a fourth embodiment of the microphone of the present invention showing the use of a knife edge affixed to the diaphragm for generating a modulated signal responsive to the motion of the microphone diaphragm by blocking a portion of the light directed between a laser light source and a detector.

A variation of the knife-edge aperture detection apparatus is accomplished using the light transmission arrangement shown in FIG. 5. Again, the light beam must have a uniform pattern, which is accomplished using optical elements 14 and 16, and is intensity modulated by the knife edge, 56, directly attached to pressure diaphragm 18. The advantage of this approach is that no reflection from an optical surface is required. Another advantage is that, generally, a knife edge aperture can be constructed to be lighter than an optical mirror; therefore, the diaphragm/aperture assembly is much less mechanically demanding than diaphragm/mirror assembly. The intensity modulated light detected by a photodiode is proportional to the displacement of the pressure diaphragm.

EXAMPLE 5

Figure 6:
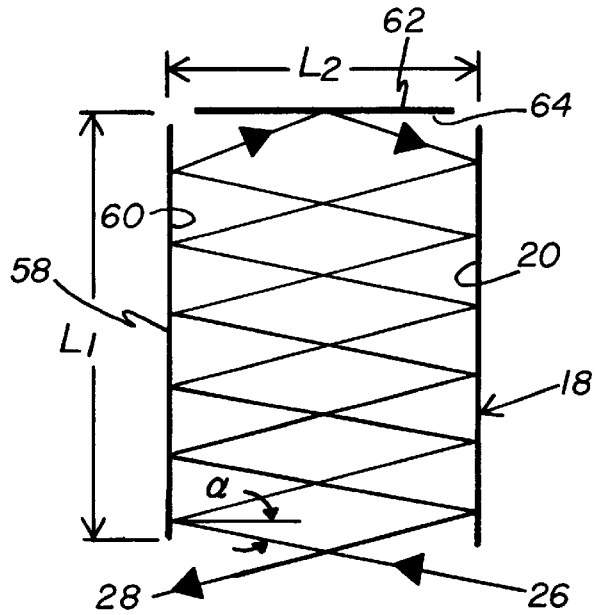
FIG. 6 is a schematic representation of the use of two additional reflecting surfaces to amplify the motion of the microphone diaphragm.

Significant improvement in sensitivity of microphones with optical transducers may be accomplished by using multiple reflection of the light as shown in FIG. 6. The light beam is directed at a steep angle into a cavity that consists of 3 reflecting surfaces 18, 58, 62, in such fashion that after multiple reflection and double pass the beam comes back to the detector located in the vicinity of the laser. One of the surfaces (e.g. surface 18) is the pressure diaphragm. The beam displacement, $X_N$, experienced on the detector surface is given by $$X_N = NX \quad (4)$$

where N is a total number of light beam reflections from the pressure diaphragm surface and X is the displacement of the pressure diaphragm by the sound wave to be recorded. Thus, the detection sensitivity and, therefore, the signal-to-noise-ratio is enhanced by a factor of N. The smaller the entrance angle, γ, the larger N becomes. With appropriate design of the cavity (angle γ, geometrical dimensions of the cavity, $L_1$ and $L_2$), the amplification factor N can reach tens or hundreds. The configuration shown in FIG. 6 can be modified as follows: (a) mirror, 58, having reflective surface, 60, is replaced by a second pressure diaphragm; (b) surface, 62, having reflective surface, 64, may be replaced by a detector producing only a single pass of the laser beam through the cavity, if geometrical design considerations required such a design; and (c) the number of reflecting surfaces (or pressure diaphragms) is increased to any desired number (determined by the particular application) in a three-dimensional configuration.

EXAMPLE 6

Figure 7:
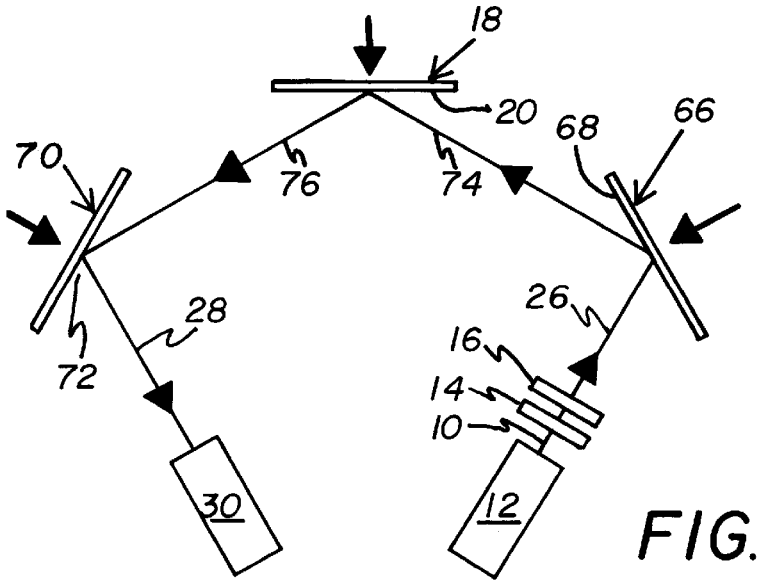
FIG. 7 is a schematic representation of the use of multiple diaphragms and a single laser light source and position sensitive detector to generate an amplified acoustical signal.

A multiple diaphragm configuration is expected to generate improved performance and increase versatility of microphones using optical transducers. FIG. 7 illustrates an apparatus where a single transducer 30 receives the reflected light beam from several pressure diaphragms (18, 66, and 70, having reflective surfaces 20, 68, and 72, respectively), from a single light source 12, and resulting in a situation where the displacement of each pressure diaphragm is linearly added and detected. This configuration permits a variety of directional microphone patterns to be envisioned, making optical transducer microphones much more flexible.

The foregoing description of the invention has been presented for purposes of illustration and description and is not intended to be exhaustive or to limit the invention to the precise form disclosed, and obviously many modifications and variations are possible in light of the above teaching. For example, it would be apparent to one having ordinary skill in the art of optics after reading the present disclosure that optical fibers could be used to direct laser light onto the microphone diaphragm and to collect reflected light therefrom in order to minimize microphone size and the unwanted contribution of stray light to the detected signal. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An optical microphone having a pressure-actuated diaphragm responsive to sound waves impinging thereon, comprising in combination:

(a) reflective means attached to said pressure-actuated diaphragm and adapted to move therewith;

(b) a light source for directing light having a chosen intensity onto said reflective means; and (c) means for detecting the position of the light reflected by said reflective means and generating a signal therefrom, whereby the generated signal is independent of the intensity of the light.

2. The optical microphone as described in claim 1, wherein said light source includes lasers and light emitting diodes.

3. The optical microphone as described in claim 1, wherein said reflective means comprises a reflective coating on the opposite side of said diaphragm from the impinging sound waves.

4. The optical microphone as described in claim 3, further comprising:

(i) a first reflective surface approximately co-extensive with said diaphragm, parallel thereto and spaced apart therefrom, wherein the reflective coating of said diaphragm faces said first reflective surface; and (ii) a second reflective surface substantially perpendicular to said diaphragm and to said first reflective surface, wherein said first reflective surface and said second reflective surface are disposed such that light from said light source is reflected a plurality of times alternatively between said diaphragm and said first reflective surface until the light reaches said second reflective surface, whereupon it is reflected and is again reflected a plurality of times alternatively between said diaphragm and said first reflective surface until the light exits the space between said diaphragm and said first reflective means and is detected by said position detecting means, whereby the motion of said diaphragm is amplified.

5. The optical microphone as described in claim 3, further comprising: at least one second pressure-actuated diaphragm responsive to sound waves impinging thereon, each of said at least one second diaphragms having a reflective coating on the opposite side of said at least one second diaphragm from the impinging sound waves, wherein light from said light source reflected from said reflective coating of said diaphragm is serially incident on the reflective coating of said at least one second diaphragm, and wherein the light reflected from the reflective coating of the last of said at least one second diaphragm is detected by said position detecting means, whereby the motion of said diaphragm is amplified by the motion of said at least one second diaphragm.

6. The optical microphone as described in claim 1, wherein said reflective means comprises a mirror disposed on the opposite side of said diaphragm from the impinging sound waves.

7. The optical microphone as described in claim 1, wherein said means for detecting the position of the light reflected by said reflective means comprises a position-sensing detector.

8. The optical microphone as described in claim 1, wherein said means for detection the position of the light reflected by said reflective means comprises dual element detectors.

9. The optical microphone as described in claim 1, wherein the generated signal is linearly dependent upon the motion of said diaphragm in response to sound waves impinging thereon.

10. An optical microphone having a pressure-actuated diaphragm responsive to sound waves impinging thereon, comprising in combination:

(a) reflective means attached to said pressure-actuated diaphragm and adapted to move therewith;

(b) a light source for directing light having a chosen intensity onto said reflective means;

(c) knife-edge means having a fixed position for blocking a portion of the light reflected by said reflective means; and (d) means for detecting the intensity of the portion of the light which is not blocked by said knife edge and generating a signal therefrom.

11. The optical microphone as described in claim 10, wherein said light source includes lasers and light emitting diodes.

12. The optical microphone as described in claim 10, wherein said reflective means comprises a reflective coating on the opposite side of said diaphragm from the impinging sound waves.

13. The optical microphone as described in claim 10, wherein said reflective means comprises a mirror disposed on the opposite side of said diaphragm from the impinging sound waves.

14. The optical microphone as described in claim 12, further comprising:

(i) a first reflective surface approximately co-extensive with said diaphragm, parallel thereto and spaced apart therefrom, wherein the reflective coating of said diaphragm faces said first reflective surface; and (ii) a second reflective surface substantially perpendicular to said diaphragm and to said first reflective surface, wherein said first reflective surface and said second reflective surface are disposed such that light from said light source is reflected a plurality of times alternatively between said diaphragm and said first reflective surface until the light reaches said second reflective surface, whereupon it is reflected and is again reflected a plurality of times alternatively between said diaphragm and said first reflective surface until the light exits the space between said diaphragm and said first reflective means and is detected by said position detecting means, whereby the motion of said diaphragm is amplified.

15. The optical microphone as described in claim 13, further comprising: at least one second pressure-actuated diaphragm responsive to sound waves impinging thereon, each of said at least one second diaphragms having a reflective coating on the opposite side of said at least one second diaphragm from the impinging sound waves, wherein light from said light source reflected from said reflective coating of said diaphragm is serially incident on the reflective coating of said at least one second diaphragm, and wherein the light reflected from the reflective coating of the last of said at least one second diaphragm is detected by said position detecting means, whereby the motion of said diaphragm is amplified by the motion of said at least one second diaphragm.

16. The optical microphone as described in claim 10, wherein the generated signal is linearly dependent upon the motion of said diaphragm in response to sound waves impinging thereon.

17. An optical microphone having a pressure-actuated diaphragm responsive to sound waves impinging thereon, comprising in combination:

(a) a light source for providing light having a chosen intensity;

(b) means for detecting the intensity of the light from said light source and generating a signal therefrom; and (c) a knife edge attached to said pressure-actuated diaphragm and adapted to move therewith, whereby said knife edge intersects the light between said light source and said detector means and modulates the intensity of the light in an amount proportional to the motion of said diaphragm.

18. The optical microphone as described in claim 17, wherein said light source includes lasers and light emitting diodes.

19. The optical microphone as described in claim 17, wherein the generated signal is linearly dependent upon the motion of said diaphragm in response to sound waves impinging thereon.

* * * * *